United States Patent [19]

Maser

[11] 4,000,621

[45] Jan. 4, 1977

[54] REMOTE SEALING OF MINE PASSAGES CONTAINING FLOWING WATER

[75] Inventor: Kenneth R. Maser, Lexington, Mass.

[73] Assignee: The United States of America as represented by the Secretary of the Interior, Washington, D.C.

[22] Filed: June 19, 1975

[21] Appl. No.: 588,549

[52] U.S. Cl. ..... 61/35

[51] Int. Cl.[2] ..... E02D 3/12

[58] Field of Search ..... 61/35, 36 R, 50; 299/11

[56] References Cited

UNITED STATES PATENTS

| | | | |
|---|---|---|---|
| 3,421,587 | 1/1969 | Heavilon et al. | 299/11 |
| 3,440,824 | 4/1969 | Doolin | 61/35 |
| 3,469,405 | 9/1969 | Reinhold | 61/35 |
| 3,500,934 | 3/1970 | Magnuson | 61/35 |
| 3,583,165 | 6/1971 | West et al. | 61/35 |
| 3,831,383 | 8/1974 | Crank | 61/35 |
| 3,852,967 | 12/1974 | Stewart et al. | 61/35 |

*Primary Examiner*—Paul R. Gilliam
*Assistant Examiner*—Alex Grosz
*Attorney, Agent, or Firm*—William S. Brown; Donald R. Fraser

[57] ABSTRACT

Underground passages having water flowing therein are sealed remotely from the surface by first emplacing an aggregate layer on the passage floor through a borehole to a depth sufficient to allow the flowing water to percolate through the aggregate without overflowing it. Fly ash, either alone or admixed with cement or a swelling clay, is then pneumatically injected into the passage atop the aggregate. Finally, water flow is closed off by injecting a cementitious grout into the aggregate layer.

10 Claims, 3 Drawing Figures

REMOTE SEALING OF MINE PASSAGES CONTAINING FLOWING WATER

BACKGROUND OF THE INVENTION

There is often need to construct seals within underground passageways such as mine drifts or tunnels. Since access to the seal site is usually hazardous and often times impossible, there have been developed a number of techniques to construct such seals remotely from the surface. Patents illustrating developed methods for remotely constructing seals include U.S. Pat. Nos. 3,421,587, 3,469,405 and 3,583,165.

Seals are constructed within underground mine workings, especially coal mine workings, for two major purposes. First, remote sealing has been used to isolate a fire area within both active and abandoned coal mines so as to control and extinguish the fire. Remote sealing techniques also are useful to control or divert acid mine water in order to prevent or minimize pollution of surface waters. Remote sealing techniques presently employed become extremely cumbersome and difficult to implement in deep mines; those mines whose workings are a few hundred to a few thousand feet below the surface. Techniques such as those disclosed in the Heavilon et al patent, U.S. Pat. No. 3,421,587 in which dry fly ash is pneumatically injected through bore holes into the mine workings, cannot seal a passage having a significant (greater than about 20 to 50 gpm) water flow in the passage. Flowing water simply channels through the fly ash as it is emplaced and maintains an open flow passage along the floor area even if the mine passage is filled to refusal with fly ash.

My invention provides a technique for remotely constructing seals in underground passages in the presence of water flowing therein. Seals can be constructed to withstand a large hydraulic head even in the presence of relatively high velocity, large volume water flows.

SUMMARY OF THE INVENTION

I have found that a seal may be remotely constructed in an underground passage having water flowing therein by providing a diversion path for the water during construction of the seal and thereafter closing off the diversion path. This is accomplished by drilling at least one borehole communicating from the surface to the passage through which a first layer of sized aggregate is dispersed over the floor of the passage. Sufficient sized aggregate is emplaced on the passage floor to allow percolation of the flowing water through the aggregate layer without water overflowing the layer. A dry sealing material, which may comprise fly ash alone or admixed with cement or a swelling clay such as bentonite, is then pneumatically emplaced atop the aggregate layer. Thereafter, a cementitious grout is injected into the aggregate layer to close off the water flow path and complete the seal.

Hence, it is the object of my invention to construct seals in underground passages containing flowing water.

DETAILED DESCRIPTION OF THE INVENTION

Figure 1:
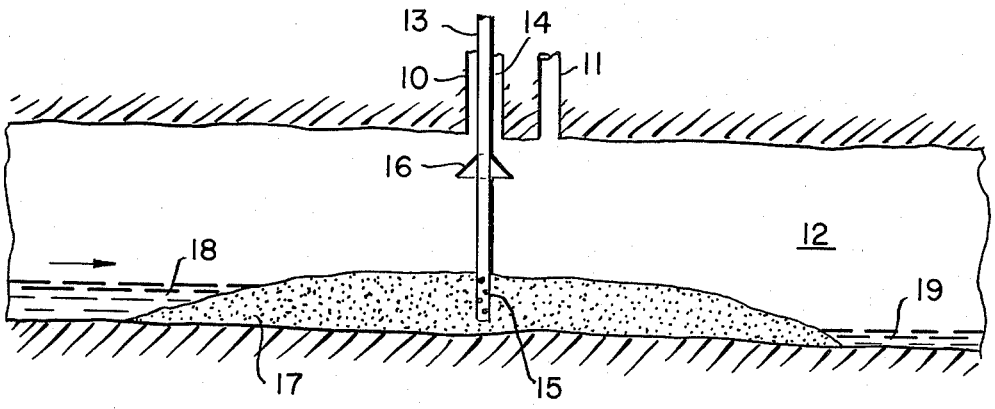
FIGS. 1–3 illustrate successive stages in the construction of a seal according to a preferred embodiment of my invention.

With reference to the drawings, my technique for constructing seals in underground passages containing flowing water requires providing at least one, and preferably two, boreholes, 10 and 11, communicating from the surface to intersect the underground passage 12. The boreholes are preferably cased from the surface to the roof of the passage. A grout pipe 13, substantially smaller in external diameter than the internal diameter of the cased borehole, is extended from the surface to the floor of the passage through one of the boreholes leaving an open annular area 14. Grout pipe 13 is provided with orifices 15 in the lower portion thereof. In addition, grout pipe 13 is preferably equipped with deflector means 16 which are attached to the pipe at a point below but near the roof of passage 12. Deflector means 16 preferably comprise a collapsible conical shield which can be expanded into its open position remotely from the surface after emplacement of the grout pipe.

After grout pipe 13 is in place within borehole 10, aggregate is introduced into the passage through annulus 14 either by gravity or with pneumatic assistance. The aggregate impinges upon deflector 16 and is spread fairly uniformly in a layer 17 over the width of the passage and along a considerable length of the passage floor. A sufficient depth of aggregate is emplaced within the passage to allow the flowing water 18 to percolate through aggregate layer 17 without overflowing it. Generally, an aggregate layer of 1 to 1 ½ feet in depth is sufficient for this purpose. The aggregate should be relatively closely sized so as to allow maximum water permeability and should be essentially free of fines. Top size of the aggregate is that which can be introduced through annulus 14 without danger of plugging. A generally appropriate size range is − 1 + ¼ inches but a more closely sized aggregate, such as − ¾ + ¼ inches is preferred. Aggregate layer 17 tends to back up water 18 flowing through the passage in the direction indicated by the arrow. After percolating through the aggregate, water depth decreases to that level existing before placement of the aggregate as is indicated by reference numeral 19.

Figure 2:
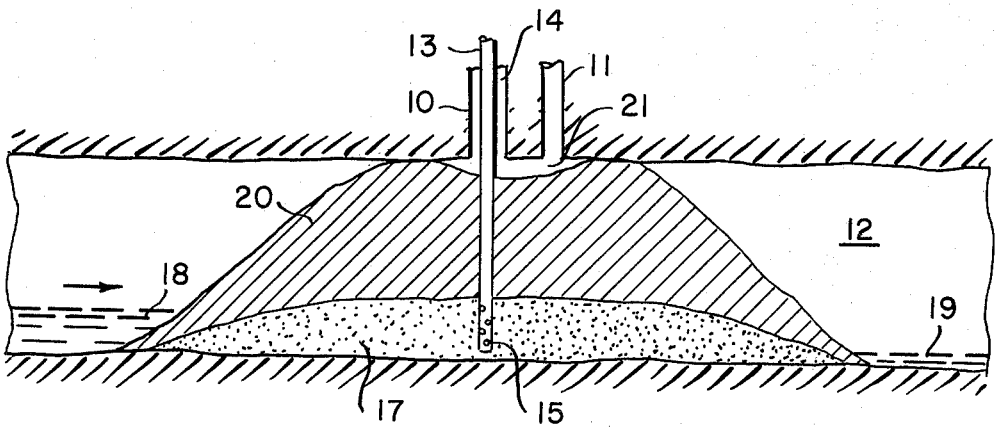

Referring now to FIG. 2, there is shown the next stage in the construction of the seal. Dry fly ash is pneumatically injected down borehole 11 to form a plug 20 atop aggregate layer 17. Fly ash is injected in such a manner as to provide a complete seal of passage 12. While conventional techniques of pneumatically injecting dry fly ash using the integral blower capacity of a pneumatic tank truck may be used at shallow depths, I prefer to employ injection in dilute phase at high velocity as is disclosed in my commonly assigned U.S. Pat. No. 3,927,719. That technique uses a supplemental source of gas or air in addition to that provided by the pneumatic truck compressor to inject fly ash into an underground void. At low solids loadings with high has flow rates, fly ash is distributed in a different manner. The gas jet, issuing into the mine passage from the borehole, produces a large crater under the hole and pushes the fly ash to the sides of the passage so that the corners are sealed first. Thus the seal progresses from the outer edge inwardly and finally produces a seal having a broad area extending from the lip of the crater 21 formed beneath the injection borehole to the flanking slopes of the deposited fly ash.

Fly ash injection is continued until a complete seal of the mine passage is obtained. In those cases where the finished seal must withstand a substantial water head and in circumstances where a permanent seal is desired, I prefer to mix with the fly ash either a swelling clay such as bentonite or cement. Best results are obtained using about 20 to 30% bentonite by weight mixed with the fly ash or with a cement-fly ash ratio of about 1:6. The clay-fly ash or cement-fly ash mixture absorbs water by capillary action. In the case of cement-fly ash mixtures, a noticable set develops within 10 to 30 minutes after the mixture absorbs capillary water. In those cases where mixtures of clay-fly ash or cement-fly ash are used, the total quantity of particulate material required to construct a seal is less than that required when fly ash is used done. This is because the mixtures tend to settle faster than does fly ash and because the angle of repose of the flanking slopes of the seal is steeper when mixtures are used.

In some cases also, it is advantageous to inject an expanding foam, such as polyurethane, into the crater area 21 beneath the borehole after injection of fly ash is complete. This may be accomplished by mixing a two-component froth foam downhole directly above the crater area. The two foam components are delivered through separate conduits to a mixing head emplaced at the bottom of the injection borehole. Mixing of the two components produces a mobile but relatively quick setting foam which fills all remaining void spaces in the crater area of the seal.

Figure 3:
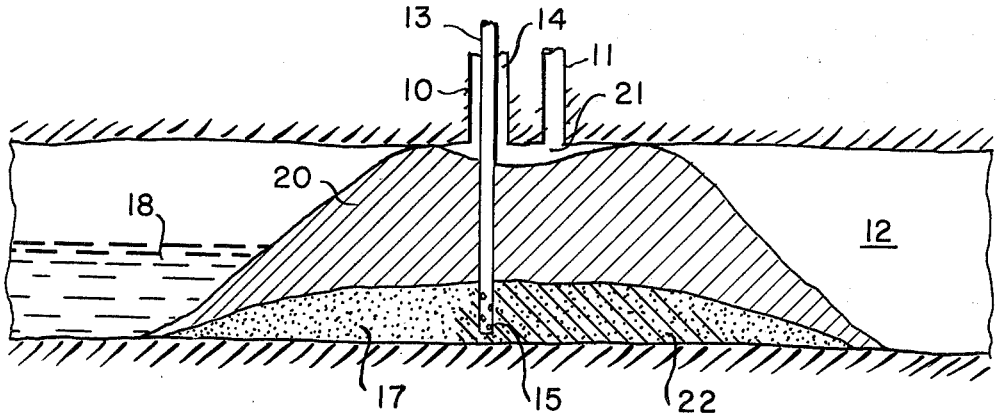

Referring now to FIG. 3, there is shown the final step in the construction of the seal. Water flow through aggregate layer 17 is blocked by injection of a pumpable cementitious grout 22 through grout pipe 13 and out orifices 15 into the aggregate. Sufficient grout is injected to completely permeate an entire cross sectional area of the aggregate layer. The grout used must be pumpable yet it is preferred that it have a relatively fast set time so that grout erosion by water flow through the aggregate is minimized. Appropriate grout compositions for use in this application are well known in the art. For example, a grout composition comprising a slurry of 55% fly ash and 45% water by weight, mixed with about 12% Regulated Set Portland Cement by weight of fly ash, was found to give good results. This particular grout composition set in about 10 minutes.

While this invention has been described as utilizing two boreholes for construction of the seal, it is also possible to construct a seal in the same manner utilizing but one borehole. When the two hole method is used, it is necessary that the two boreholes intersect the underground passage in close proximity to each other; preferably less than 20 feet apart and most preferably at a spacing of about 5 to 10 feet. Such controlled drilling is relatively easy to accomplish at shallow to moderate depths, on the order of 100 to 500 feet, but directional control of the borehole becomes more difficult as depth increases.

When one borehole is used, the following procedure is applicable. The borehole is drilled to intersect the underground passage and is preferably cased from the surface to the roof of the passage. Grout pipe 13 is then emplaced to the floor of the passage. Deflector 16 is deployed and aggregate is introduced through annulus 14 to form aggregate layer 17. Deflector 16 is then removed so that it will not interfere with fly ash placement. This may be accomplished by mounting deflector 16 on grout pipe 13 using a shear pin-wire line arrangement whereby the pin can be severed after aggregate emplacement thus allowing the deflector to drop to a position atop aggregate layer 17.

Fly ash, or mixtures of fly ash with cement or clay, is then injected down annulus 14 as before described. After injection of fly ash is complete, a cementaceous grout is pumped down pipe 13 to permeate aggregate layer 17 and seal off water flow through the layer. If a foam topping to the seal is desired, grout pipe 13 is then pulled from the borehole and an expanding froth foam is injected into the crater area of the seal as before described.

I claim:

1. A remote method for constructing a seal in an underground passage through which water is flowing which comprises:

drilling at least one borehole, but no more than two boreholes, from the surface to intersect the passage;

distributing a layer of relatively coarse aggregate over the floor of the passage to a depth sufficient to allow percolation of the flowing water through the aggregate layer without water flow over the top of said layer;

pneumatically injecting a particulate material consisting essentially of fly ash, fly ash admixed with a swelling clay or fly ash admixed with cement down the borehole until said passage is completely filled with the particulate material along a substantial length thereof to form a water impervious plug atop the aggregate layer, and injecting a cementitious grout into said aggregate layer to seal off water flow through the aggregate.

2. The method of claim 1 wherein two boreholes are drilled from the surface to intersect said passage in close proximity to each other and wherein one borehole is utilized to introduce aggregate into said passage and to introduce cementitious grout into said aggregate layer and wherein the second borehole is utilized to pneumatically inject said particulate material atop the aggregate layer.

3. The method of claim 1 wherein the size range of said aggregate is $-\frac{3}{4}+\frac{1}{4}$ inch.

4. The method of claim 1 wherein said particulate material consists essentially of fly ash.

5. The method of claim 1 wherein said particulate material consists essentially of fly ash admixed with a swelling clay.

6. The method of claim 5 wherein the swelling clay is bentonite and wherein said bentonite is admixed with fly ash in an amount in the range of 20 to 30% by weight.

7. The method of claim 1 wherein said particulate material consists essentially of fly ash admixed with cement.

8. The method of claim 7 wherein the ratio of cement to fly ash in the particulate material is about 1:6.

9. The method of claim 1 wherein said particulate material is pneumatically injected in dilute phase at high gas velocity to substantially seal said passage and to form a crater-like depression beneath the injection borehole and wherein said crater-like depression is thereafter filled with an expanding foam.

10. The method of claim 9 wherein said expanding foam is generated by mixing a two-component froth foam downhole directly above the crater area.

* * * * *